United States Patent [19]

Duncan

[11] 4,395,794

[45] Aug. 2, 1983

[54] DEVICE TO TAKE UP REFUSE BY VACUUM INTAKE AIR

[75] Inventor: Ian J. Duncan, St. Blasien, Fed. Rep. of Germany

[73] Assignee: Ing. Alfred Schmidt GmbH, St. Blasien, Fed. Rep. of Germany

[21] Appl. No.: 148,210

[22] Filed: May 8, 1980

[30] Foreign Application Priority Data

May 9, 1979 [DE] Fed. Rep. of Germany ..... 2918759
May 9, 1979 [DE] Fed. Rep. of Germany ..... 2918760

[51] Int. Cl.[3] ..... A47L 5/00; A47L 9/00
[52] U.S. Cl. ..... 15/340; 15/420
[58] Field of Search ..... 15/340, 346, 374, 420, 15/416

[56] References Cited

U.S. PATENT DOCUMENTS 1,272,665 7/1918 Isom ..... 15/340
1,782,882 11/1930 Rippey ..... 15/420
2,131,398 9/1938 Hubbart ..... 15/340
2,235,226 3/1941 Lofgren et al. ..... 15/420
3,054,130 9/1962 Ferrari ..... 15/340
3,984,894 10/1976 Brock et al. ..... 15/340

*Primary Examiner*—Philip R. Coe
*Assistant Examiner*—Timothy F. Simone
*Attorney, Agent, or Firm*—Murray Schaffer

[57] ABSTRACT

A vacuum cleaner intake device formed of a V-shaped housing widening in the direction of working. The housing has a funnel shape nozzle, a fitting at the apex of the nozzle for connection to a source of suction and a pair of arms extending in a V-shape respectively forwardly and laterally of the nozzle. A pair of side walls are provided each having a skid at its lower edge elevating said housing above the floor. A hood covers and defines with the arms and the side walls a collection chamber open at the forward and rear edges. Each of the arms are provided on their bottom surface with a pair of spaced battens defining between them an elongated suction groove open to the collection chamber and extending outwardly through the side wall.

11 Claims, 7 Drawing Figures

DEVICE TO TAKE UP REFUSE BY VACUUM INTAKE AIR

BACKGROUND OF THE INVENTION

The present invention relates to a vacuum cleaner take up device by which refuse is collected. The device is provided with a nozzle adapted to be connected to a source of suction. The nozzle is situated only a short distance from the floor surface to be cleaned at the apex of a V-shaped housing which widens in the direction of working and which forms a collecting chamber covered at the top by a hood. The refuse is collected in the chamber and fed to the nozzle, if necessary, with the aid of rotating brushes.

In a known device of this type (GB-PS 1 530 904), there is inadequate suction power in the outer zones of the V-shaped part of the housing. A hood covers the collecting chamber in front of the nozzle of the suction tube and is fitted on its interior inside with a flexible lining, which is joined to the hood along its edges, so that it is drawn toward the floor by the suction effect and thereby prematurely destroyed.

It is an object of the present invention to provide a device of the type mentioned so that a larger width of refuse can be taken up by means of a strong suction action, having regard to all refuse problems.

SUMMARY OF THE PRESENT INVENTION

According to the present invention the problems found in the prior art are resolved by providing a head in which the housing is in part formed by two arms arranged in the form of a V-shaped housing and act as a refuse batten. The arms include a suction channel opening out at the side and towards the surface of the floor and being limited between, as seen from the direction of travel, a front and rear batten. The suction orifice of the nozzle is joined to the collecting chamber and the two side suction channels.

Whilst the suction orifice in the area of the nozzle is generally of sufficient size to take up cans, bottles and suchlike, the suction channels joined at the side to the suction orifice ensure that an increased effective width for additional refuse is obtained. Due to the refuse battens being in the shape of a "V" large pieces are flung directly in front of the suction orifice, where they are drawn in by the vacuum intake air.

Small but relatively heavy items of refuse such as stones are drawn in in the area of the side suction channels and conveyed to the suction aperture. Due to the relatively small cross section of the air channels, a relatively high speed suction air flow is ensured.

Within the scope of the invention, the front and rear limiting components of the suction channels can be designed as contacting or non-contacting components.

In the present invention, a funnel shaped nozzle spread between the suction tube connection and housing across the direction of working has been found expedient. Its back face and the side piece battens extending downwards form an acute angle with the surface of the floor, pointing in the direction of working. In addition to the suction action, because of the last mentioned measure, large volume components of refuse are shovelled up in the area of the nozzle and, therefore, released from the surface of the floor, so that they are lifted into the suction stream and accelerated accordingly. This action is improved even more by providing the top of the hood with its lining sagging towards the floor so that the lining is subject on both sides to the suction action from the suction tube.

In normal circumstances a lining of this type reduces the inlet aperture in accordance with an accurately adjustable maximum slackness, so that a high suction speed results. Unevenness of the floor is easily accommodated by the flexible lining, i.e. it shapes itself according to the bulges in the floor without being fixed firmly to the floor during the suction action.

An advantageous design of the invention envisages that the lining be fixed only along the front and rear edges, running in each case transverse the direction of working. The side edges, however, are left loose so that they are skirted by the suction flow. A rubber apron is particularly suitable as a lining, but a similar flexible form of simulated rubber material or plastic can be used.

A lining of this type has, however, not only the property of reducing in normal use, the suction cross section but a still further improvement in performance of taking in refuse by the fact that it is stimulated to vibrate under the action of the air flow, whereby the current of air pulsates at a frequency of approximately 1/sec. This results in a constant but controllable change in distance between lining and floor surface, therefore, in sudden changes in suction speed, so that it is even possible to loosen and draw in chips and firmly fixed refuse from the surface of the floor.

The vibrating action of the lining can be used to better advantage by further development of its shape, in that the lining is fixed only along the front edge while along the rear edge it may be suspended on cables, so as to be movable. The cables serve at the same time to prevent the lining from touching the floor.

Finally, the vibrating action of the lining can be influenced by numerous additional factors, for example, by the thickness of the lining material, the stiffness of the lining material, particularly the lining may be made of stretch-free material and the space between the lining and the top of the hood filled with easily deformable filling material, for example, in the form of loose "bulk" material.

The invention is explained more fully in the following description with the aid of the accompanying drawing.

BRIEF DESCRIPTION OF THE DRAWING IN THE DRAWINGS

DESCRIPTION OF THE INVENTION

Figure 1:
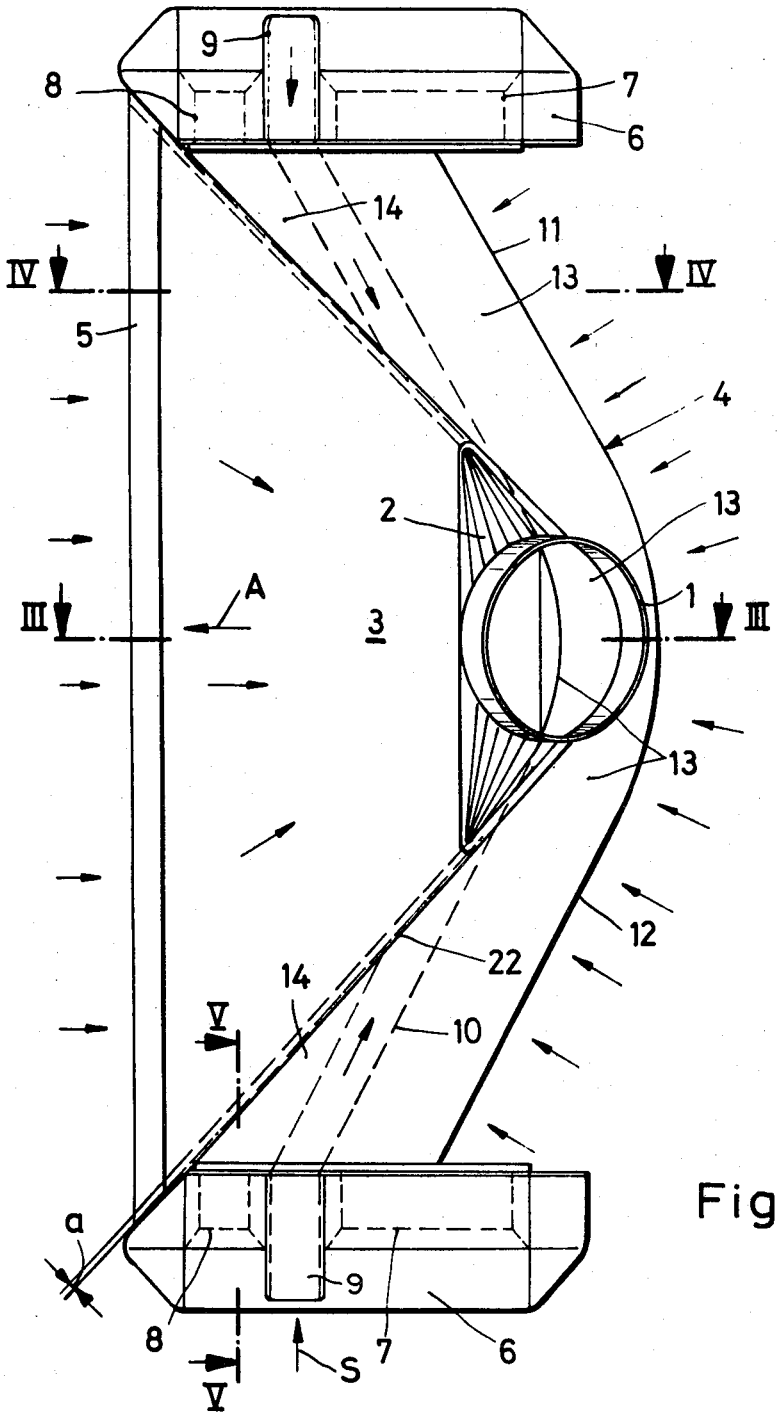
FIG. 1 is a plan view of the take-up device of the present invention.

The vacuum cleaner take-up device of the present invention, is seen in FIG. 1 standing sideways. It comprises a housing having a flange 1 for connection to a suction tube (not shown). A funnel-shaped nozzle 2 is molded to the bottom of the connecting flange and is itself connected to a horizontal hood 3. Connected to the sides and rear of the hood 3 are arms 4 which depend downwardly and to the rear in a V-shape arrangement. The hood 3 and arms 4 define a suction and orifice 16, a refuse collection chamber which is also in the direction of working denoted by arrow A. The hood 3 terminates in an edge 5 which is bent upwards. The arms 4 terminate in side wall components 6 which form the side limits of the housing. They each have a sliding skid 15 divided into a front wearing strip 8 and a rear wearing strip 7. Between the front and rear wearing strips there is in each side wall, a suction intake 9, through which the air is drawn in the direction of arrow S (FIG. 1) and flows via a suction channel 10 (drawn as a broken line) into the nozzle 2. The suction channel 10 is formed within the flanks 11 and 12 of the V arranged arms 4 and is limited by a rear batten 13 and a front batten 14. The battens 13 and 14 extend in a horizontal plane across the entire width of the housing between the sides 6. The arrows show the direction of the suction air flow, that is, from the front through the orifice of hood 3 and from the rear through the gap between the surface of the floor and the rear batten 13.

Figure 2:
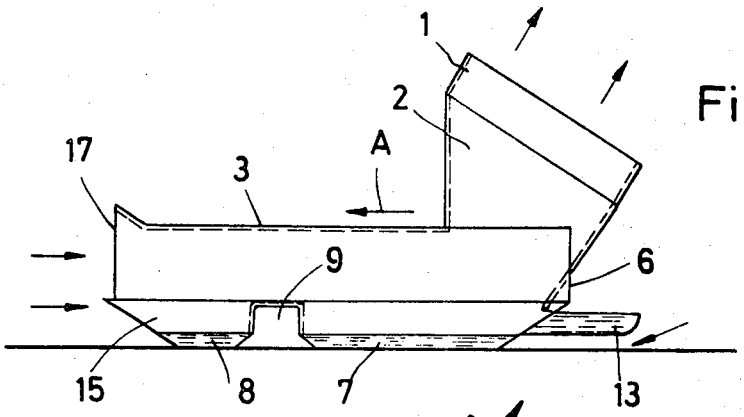
FIG. 2 is a side view of the take-up device of FIG. 1.

In the side view shown in FIG. 2, the side suction intake 9 of the corresponding suction channel 10 can be clearly seen; it extends upwardly the full height of the side 6 i.e.: the sliding skid 15 including its wearing strips 7 and 8.

Either or both of the battens 13 and 14 can be made in lamina form, i.e., of a plurality of sheets, preferably of plastic or rubber and are fixed to the bottom of the housing or arms 3 and 4 so that they run parallel to the surface of the floor. At least one of the battens 13 and 14 is of height that will substantially brush or sweep the floor, thus comprising a brushing strip as seen in FIG. 4. In this form a rubber flap is preferable. The batten 13 or 14 may also be of a more rigid plastic and function as a scraper or scraping strip, such as batten 13, shown in FIG. 3.

FIG. 2 also shows how the side wall 6 bounds the hood 3 from the rear of which the funnel 2 with the connecting flange 1 extends. The low pressure zone formed in front of the suction orifice 16, FIG. 3, draws air from the front, through the inlet opening 17 beneath the hood 3 and also from behind below the rear batten 13.

Figure 3:
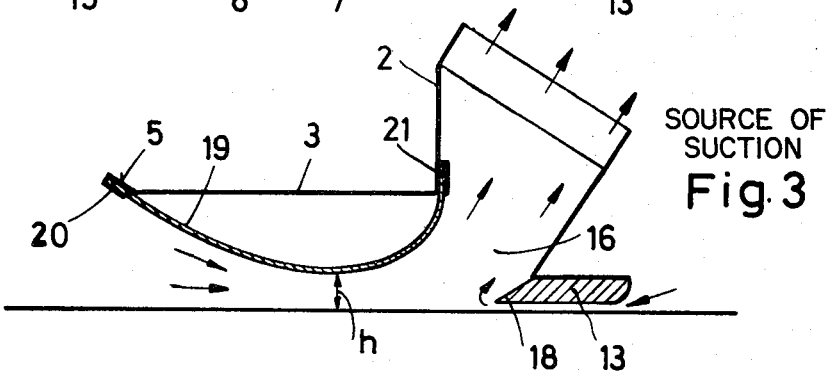
FIG. 3 is a section through line III—III of FIG. 1.
Figure 4:
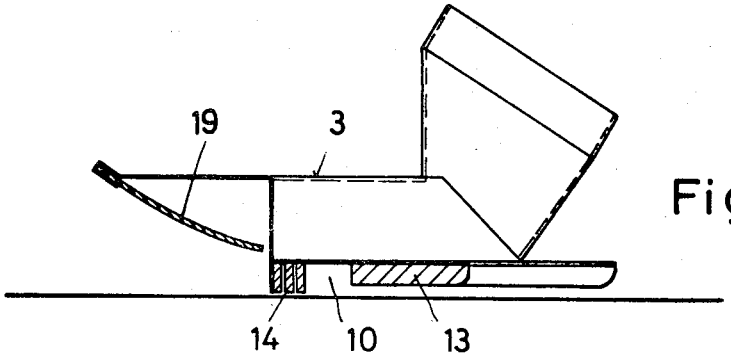
FIG. 4 is a section through line IV—IV of FIG. 1.

In the section shown in FIG. 3, the rear batten 13 is again visible, which tapers to a point on its front edge 18. Within the housing, the hood 3 is provided with a flexible lining 19 e.g. a rubber apron, the bottom of which sags downwards. The lining 19 is fixed at the front to the sloping edge 5 of the hood 3 by means of a clamping strip 20 and on the inside of the nozzle 2 in the area of the suction orifice 16 by means of a further clamping strip 21. The lining 19 effects a lowering of the height of the suction cross-section to dimension h, without, however, appreciably limiting the maximum height of the hood 3 for the throughput of large volume refuse. Due to the lowering of the suction cross-section achieved by the lining 19, there results a desirable increase in speed of the air flow.

Whilst the section shown in FIG. 3 shows merely the rear batten 13 which is continuous across the wole width of the housing of the device. The section shown in FIG. 4 shows the front batten 14 as well as the cross section of the suction channel 10 formed between the two battens.

Figure 5:
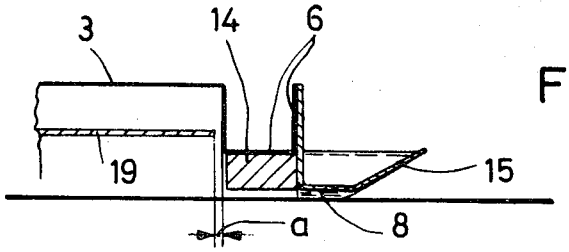
FIG. 5 is a section through line V—V of FIG. 1.

The section shown in FIG. 5, running transverse to the direction of travel shows in particular, the design of a side wall 6 as well as the cross-sectional shape of a sliding skid 15 with the wearing strip 8 fixed below it. The lining 19, free along its side edges, forms a gap of width (a) with the inner surface of the side walls 22 of the hood 3. This is also seen in FIG. 1. The space above the lining 19 is thereby also under the influence of the suction, so that the danger of a downward sucking of the lining is avoided.

Figure 6:
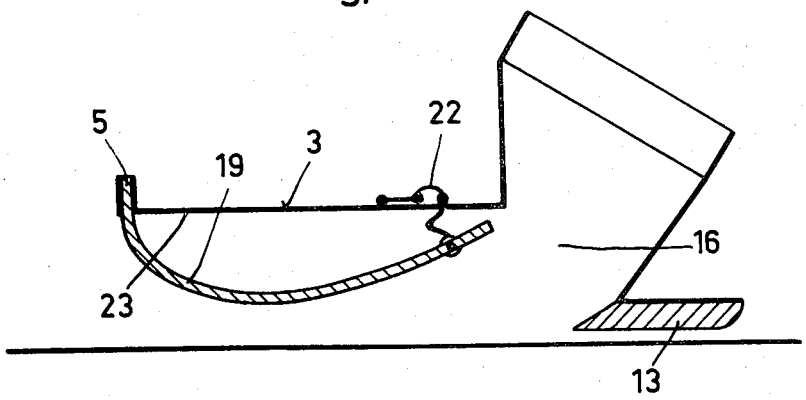
FIGS. 6 and 7 are views similar to FIG. 3 showing other variants.

In FIG. 6 the lining 19 is only firmly clamped along the front edge. At the rear edge, the lining 19 is left loose and is only held against sagging downwards by one or more cables 22. Due to the suction effect in the area of the suction orifice 16, the lining 19 is held in suspension, so that it flutters in the suction stream and achieves the desired pulsations of the suction air flow.

Figure 7:
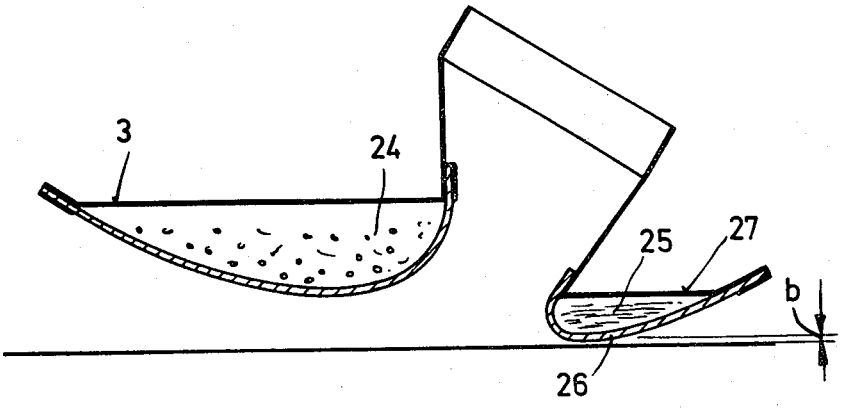

FIG. 7 shows a variant, in which instead of the rear refuse plate 13, a further apron 26 of flexible material is provided, which facilitates a very narrow adjustment of the rear suction gap of width (b). The lining 19 and also the apron 26 are loaded with loose material. The space between the lining 19 and the hood 3 is filled completely or in part with a granular material 24, the space between the apron 26 and a top cover plate 27 with a scaly material 25. Here, the assumption is that the rubber material has a fabric lining which limits stretching. There are obviously other suitable materials of stretch-free, flexible sheeting.

I claim:

1. A vacuum cleaner intake device comprising a housing having a funnel shape nozzle, a flange at the apex of said nozzle adapted for connection to a source of suction, a pair of arms extending in a V-shape respectively forwardly and laterally of said nozzle, a pair of side walls each having a skid at its lower edge elevating said housing above the floor, and a hood covering and defining with said arms and said side walls a collection chamber, open at the forward and rear edges, each of said arms having on their bottom surface, a pair of spaced battens defining between them an elongated suction channel, continuously open along its length to the floor, open to the collection chamber at one end, and extending outwardly through the side wall and open thereto.

2. The device in accordance with claim 1 wherein the top of the hood is fitted on the under side with a lining sagging towards the floor, said lining being subject on both its surfaces to the suction effect of the suction source.

3. The device in accordance with claim 2, wherein that the lining is fixed along at least one of the front and rear edges and is maintained free along the side edges so that suction air flow is permitted thereover.

4. The device in accordance with claim 3 wherein the lining is fixed only along the front edge, and is freely suspended from the rear edge.

5. The device in accordance with claim 2 wherein the lining is made of stretch-free material and the space between lining and top of hood is filled with easily deformable filling material.

6. The device according to claim 1 wherein said battens are arranged so that said channels extend at an angle to each other forwardly and laterally relative to said nozzle.

7. The device according to claim 6 wherein at least one of the battens is plastic and is arranged as a scraping strip.

8. The device according to claim 1 wherein at least one of the battens is lamina and is fixed to the bottom of the housing parallel to the surface of the floor.

9. The device according to claim 1 wherein at least one of the battens comprises a brushing strip adapted to sweep the surface of the floor.

10. The device according to claim 9 wherein said batten is a resilient flexible flap.

11. The device according to claim 1 wherein the rear wall of the nozzle and the rear batten of said pair of battens form an acute angle with the surface of the floor.

* * * * *